US012799614B2

(12) United States Patent
Park

(10) Patent No.: US 12,799,614 B2
(45) Date of Patent: Nov. 17, 2026

(54) POROUS BASE LAYER AND ELECTROCHEMICAL DEVICE

(71) Applicants: HYUNDAI MOTOR COMPANY, Seoul (KR); Kia Corporation, Seoul (KR)

(72) Inventor: Young June Park, Yangpyeong-gun (KR)

(73) Assignees: HYUNDAI MOTOR COMPANY, Seoul (KR); Kia Corporation, Seoul (KR)

( * ) Notice: Subject to any disclaimer, the term of this patent is extended or adjusted under 35 U.S.C. 154(b) by 661 days.

(21) Appl. No.: 18/234,056

(22) Filed: Aug. 15, 2023

(65) Prior Publication Data

US 2024/0344218 A1 Oct. 17, 2024

(30) Foreign Application Priority Data

Apr. 11, 2023 (KR) ..... 10-2023-0047636

(51) Int. Cl.
*C25B 13/02* (2006.01)
*C25B 9/19* (2021.01)
*C25B 9/60* (2021.01)

(52) U.S. Cl.
CPC ..... *C25B 13/02* (2013.01); *C25B 9/19* (2021.01); *C25B 9/60* (2021.01)

(58) Field of Classification Search
None
See application file for complete search history.

(56) References Cited

U.S. PATENT DOCUMENTS 3,055,963 A * 9/1962 Krebs ..... H01M 4/80 429/223
4,357,393 A * 11/1982 Tsuda ..... B22F 7/06 181/294
5,848,351 A * 12/1998 Hoshino ..... B22F 3/225 428/553
5,873,988 A * 2/1999 Schulze ..... C25B 11/031 204/290.12
11,326,264 B2 5/2022 Jang et al.
(Continued)

FOREIGN PATENT DOCUMENTS

JP 2004-068112 A 3/2004
JP 4400111 B2 1/2010
(Continued)

OTHER PUBLICATIONS

S.Stiber et al., "A high-performance, durable and low-cost proton exchange membrane electrolyser with stainless steel components", Energy Environ. Sci., 2022, 15, 109.
(Continued)

*Primary Examiner* — Harry D Wilkins, III
(74) *Attorney, Agent, or Firm* — Morgan, Lewis & Bockius LLP

(57) ABSTRACT

A porous base layer includes a porous base portion provided between a separator and a membrane electrode assembly (MEA), and a porous reinforcement member provided between the separator and the membrane electrode assembly and configured to suppress separation and deformation of the porous base portion, obtaining an advantageous effect of ensuring performance and operational efficiency and improving durability and reliability.

17 Claims, 7 Drawing Sheets

(56) References Cited

U.S. PATENT DOCUMENTS

| | | | | |
|---|---|---|---|---|
| 11,502,305 | B2 | 11/2022 | Hayakawa et al. | |
| 2006/0201800 | A1* | 9/2006 | Nakazawa | C25B 9/65 204/280 |
| 2019/0071786 | A1 | 3/2019 | Jang et al. | |
| 2021/0066723 | A1 | 3/2021 | Hayakawa et al. | |
| 2022/0339702 | A1 | 10/2022 | Yoon | |
| 2023/0207848 | A1 | 6/2023 | Fujita | |

FOREIGN PATENT DOCUMENTS

| | | | |
|---|---|---|---|
| JP | 2010-53400 | A | 3/2010 |
| JP | 2022-26413 | A | 2/2022 |
| JP | 2022-151916 | A | 10/2022 |
| JP | 7218790 | B1 | 2/2023 |
| KR | 10-2018-0025275 | A | 3/2018 |
| KR | 10-2019-0027251 | A | 3/2019 |
| KR | 10-2020-0106970 | A | 9/2020 |
| KR | 10-2022-0146262 | A | 11/2022 |

OTHER PUBLICATIONS

Noor Ui Hassan et al., "Effect of porous transport layer properties on the anode electrode in anion exchange membrane electrolyzers", Journal of Power Sources 555 (2023) 232371.

Xiao-Zi Yuan et al., "The porous transport layer in proton exchange membrane water electrolysis: perspectives ona complex component", Sustainable Energy Fuels, 2022, 6, 1824.

Gergely Schmidt, et al., "Mass Transport in PEM Water Electrolysis", Institut fur Stromungsmechanik und Umweltphysik im Bauwesert, Leibniz Universitat Hannover, https://www.hydromech.uni-hannover.de/de/forschung/aktuelle-forschungsthemen/forschungsthema-schmidt/.

J. Lopata et al., "Effects of the Transport/Catalyst Layer Interface and Catalyst Loading on Mass and Charge Transport Phenomena in Polymer Electrolyte Membrane Water Electrolysis Devices", Journal of The Electrochemical Society, 2020, 167, 064507.

Author Unknown, "Controlling the Holding Force of a Clamping Fork via Screw Position", Thorlabs, https://www.thorlabs.com/newgrouppage9.cfm?objectgroup_id=14186, edited Dec 4, 2019.

P.J. Kim, et al., "Tailoring catalyst layer interface with titanium mesh porous transport layers", Electrochimica Acta 373 (2021) 137879.

Monjid Hamdan, "Demonstration of Integrated Hydrogen Production and Consumption for Improved Utility Operations", 2019 Fuel Cell Seminar & Energy Exposition, https://www.energy.gov/sites/prod/files/2019/12/f69/fcto-fcs-h2-scale-2019-workshop-6-hamdan.pdf, Long Beach, CA, Nov. 5, 2019.

Office Action issued in corresponding Korean Patent Application No. 10-2023-0047636 dated Apr. 2, 2025.

* cited by examiner

POROUS BASE LAYER AND ELECTROCHEMICAL DEVICE

CROSS-REFERENCE TO RELATED APPLICATION

The present application claims priority to Korean Patent Application No. 10-2023-0047636 filed on Apr. 11, 2023, the entire contents of which is incorporated herein for all purposes by this reference.

BACKGROUND OF THE PRESENT DISCLOSURE

Field of the Present Disclosure

The present disclosure relates to a porous base layer and an electrochemical device, and more particularly, to a porous base layer capable of ensuring performance and operational efficiency and improving durability and reliability.

Description of Related Art

There is a consistently increasing demand for research and development on alternative energy to cope with global warming and depletion of fossil fuel. Hydrogen energy is attracting attention as a practical solution for solving environment and energy issues.

Because hydrogen has high energy density and properties suitable for application in a grid-scale, hydrogen is in the limelight as a future energy carrier.

A water electrolysis stack, which is one of electrochemical devices, refers to a device that produces hydrogen and oxygen by electrochemically decomposing water. The water electrolysis stack may be configured by stacking several tens or several hundreds of water electrolysis cells (unit cells) in series.

A membrane-electrode assembly (MEA) is positioned at an innermost side of the unit cell of the water electrolysis stack. The membrane-electrode assembly includes a perfluorinated sulfonic acid ionomer-based electrolyte membrane capable of moving hydrogen ions (protons), and an anode electrode and a cathode electrode respectively disposed on two opposite surfaces of the electrolyte membrane.

Furthermore, a porous transport layer (PTL), a gas diffusion layer (GDL), and a gasket may be stacked on each of the external portions (external surfaces) of the membrane-electrode assembly (MEA) on which the anode and the cathode are positioned. A separator (or bipolar plate) may be disposed on an external side (external surface) of the porous transport layer (PTL) and the gas diffusion layer (GDL). The separator includes flow paths (flow fields) through which a reactant, a coolant, and a product produced by a reaction flow, or the separator may include a structure which may be substituted for the flow paths.

The information included in this Background of the present disclosure is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a porous base layer and an electrochemical device, which are configured for ensuring performance and operational efficiency and improving durability and reliability.

The present disclosure has been made in an effort to minimize deformation of and damage to a porous base layer, and stably maintain a state in which the porous base layer is in contact with a membrane electrode assembly.

Among other things, the present disclosure has been made in an effort to minimize a degree to which stress is concentrated on a particular site of the porous base layer with which a land of a separator is in contact and to minimize separation of the porous base layer.

The present disclosure has also been made in an effort to generate entirely uniform fastening pressure (pressing force) to be applied to the porous base layer.

The present disclosure has also been made in an effort to ensure rigidity of the porous base layer and manufacture the porous base layer with a small thickness to minimize mass transport overpotential of the porous base layer.

The present disclosure has also been made in an effort to improve durability, stability, and reliability.

The objects to be achieved by the exemplary embodiments are not limited to the above-mentioned objects, but also include objects or effects which may be understood from the solutions or embodiments described below.

An exemplary embodiment of the present disclosure provides a porous base layer including: a porous base portion provided between a separator and a membrane electrode assembly (MEA); and a porous reinforcement member provided between the separator and the membrane electrode assembly and configured to suppress separation and deformation of the porous base portion.

According to the exemplary embodiment of the present disclosure, the porous reinforcement member may include an accommodation space configured to communicate with the outside thereof, and the porous base portion may be accommodated in the accommodation space to be exposed to the separator and the membrane electrode assembly.

According to the exemplary embodiment of the present disclosure, the porous reinforcement member may have a thickness corresponding to a thickness of the porous base portion.

According to the exemplary embodiment of the present disclosure, the porous reinforcement member may include: a first frame portion provided on a first surface of the porous base portion; a second frame portion provided on a second surface of the porous base portion; and a support frame portion configured to support the second frame portion on the first frame portion and including a first end portion connected to the first frame portion, and a second end portion connected to the second frame portion, and the first frame portion, the second frame portion, and the support frame portion may collectively define the accommodation space.

According to the exemplary embodiment of the present disclosure, the first frame portion may include: a first-first frame provided in a first direction thereof; a first-second frame connected to the first-first frame in a second direction intersecting the first direction thereof; and a first edge frame connected to the first-first frame and the first-second frame and provided along an edge portion of the porous base portion.

According to the exemplary embodiment of the present disclosure, the second frame portion may include: a second-first frame provided in a first direction thereof; a second-second frame connected to the second-first frame in a second direction intersecting the first direction thereof; and a second edge frame connected to the second-first frame and the second-second frame and provided along an edge portion of the porous base portion.

According to the exemplary embodiment of the present disclosure, the porous reinforcement member and the porous base portion may be provided as a unitary one-piece structure.

According to the exemplary embodiment of the present disclosure, the porous reinforcement member may be made of the same material as the porous base portion.

According to the exemplary embodiment of the present disclosure, a channel, through which a target fluid flows, may be defined in one surface of the separator that faces the membrane electrode assembly, a land, with which the porous base portion is in contact, may be defined on one surface of the separator that faces the membrane electrode assembly, and the porous reinforcement member may support the land on the membrane electrode assembly.

According to the exemplary embodiment of the present disclosure, the porous base portion may include: a first porous base portion provided on a first surface of the porous reinforcement member that faces the separator; and a second porous base portion provided on a second surface of the porous reinforcement member, and the first porous base portion and the second porous base portion may be integrally connected through an accommodation space of the porous reinforcement member.

According to the exemplary embodiment of the present disclosure, the first porous base portion and the second porous base portion may be provided by thermally compressing base layer slurry including a metal element, and the porous reinforcement member may have a pore smaller in size than the metal element.

According to the exemplary embodiment of the present disclosure, the first porous base portion may have a first porosity, and the second porous base portion may have a second porosity different from the first porosity.

Another exemplary embodiment of the present disclosure provides an electrochemical device including: a membrane electrode assembly (MEA); a separator stacked on the membrane electrode assembly; and a porous base layer provided between the separator and the membrane electrode assembly, in which the porous base layer includes: a porous base portion provided between the separator and the membrane electrode assembly; and a porous reinforcement member provided between the separator and the membrane electrode assembly and configured to suppress separation and deformation of the porous base portion.

According to the exemplary embodiment of the present disclosure, the porous reinforcement member may include an accommodation space configured to communicate with the outside thereof, and the porous base portion may be accommodated in the accommodation space to be exposed to the separator and the membrane electrode assembly.

According to the exemplary embodiment of the present disclosure, the porous reinforcement member may have a thickness corresponding to a thickness of the porous base portion.

According to the exemplary embodiment of the present disclosure, the porous reinforcement member may include: a first frame portion provided on a first surface of the porous base portion; a second frame portion provided on a second surface of the porous base portion; and a support frame portion configured to support the second frame portion on the first frame portion and including a first end portion connected to the first frame portion, and a second end portion connected to the second frame portion, and the first frame portion, the second frame portion, and the support frame portion may collectively define the accommodation space.

According to the exemplary embodiment of the present disclosure, the first frame portion may include: a first-first frame provided in a first direction; a first-second frame connected to the first-first frame in a second direction intersecting the first direction; and a first edge frame connected to the first-first frame and the first-second frame and provided along an edge portion of the porous base portion.

According to the exemplary embodiment of the present disclosure, the second frame portion may include: a second-first frame provided in a first direction thereof; a second-second frame connected to the second-first frame in a second direction intersecting the first direction; and a second edge frame connected to the second-first frame and the second-second frame and provided along an edge portion of the porous base portion.

According to the exemplary embodiment of the present disclosure, a channel, through which a target fluid flows, may be defined in one surface of the separator that faces the membrane electrode assembly, a land, with which the porous base portion is in contact, may be defined on one surface of the separator that faces the membrane electrode assembly, and the porous reinforcement member may support the land on the membrane electrode assembly.

According to the exemplary embodiment of the present disclosure, the porous base portion may include: a first porous base portion provided on a first surface of the porous reinforcement member that faces the separator; and a second porous base portion provided on a second surface of the porous reinforcement member, and the first porous base portion and the second porous base portion may be integrally connected through an accommodation space of the porous reinforcement member.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
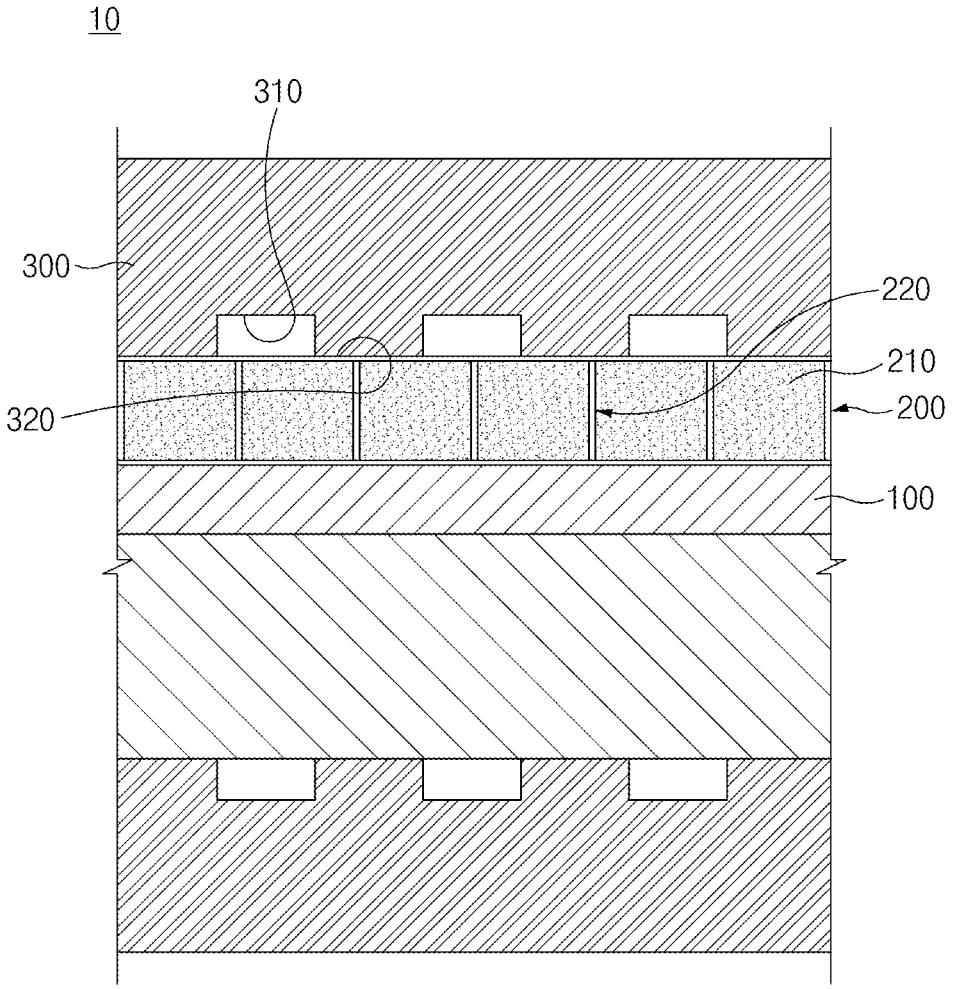
FIG. 1 is a view for explaining an electrochemical device according to an exemplary embodiment of the present disclosure.
Figure 2:
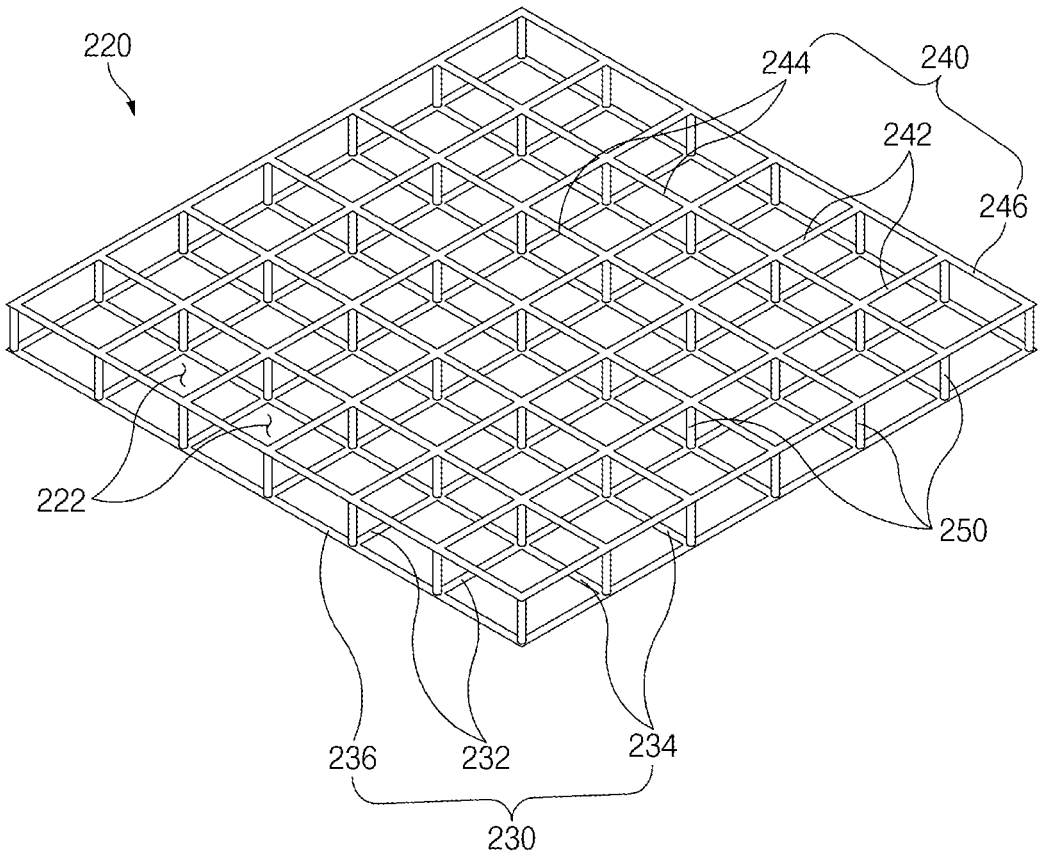
FIG. 2 is a view for explaining a porous reinforcement member of the electrochemical device according to the exemplary embodiment of the present disclosure.
Figure 3:
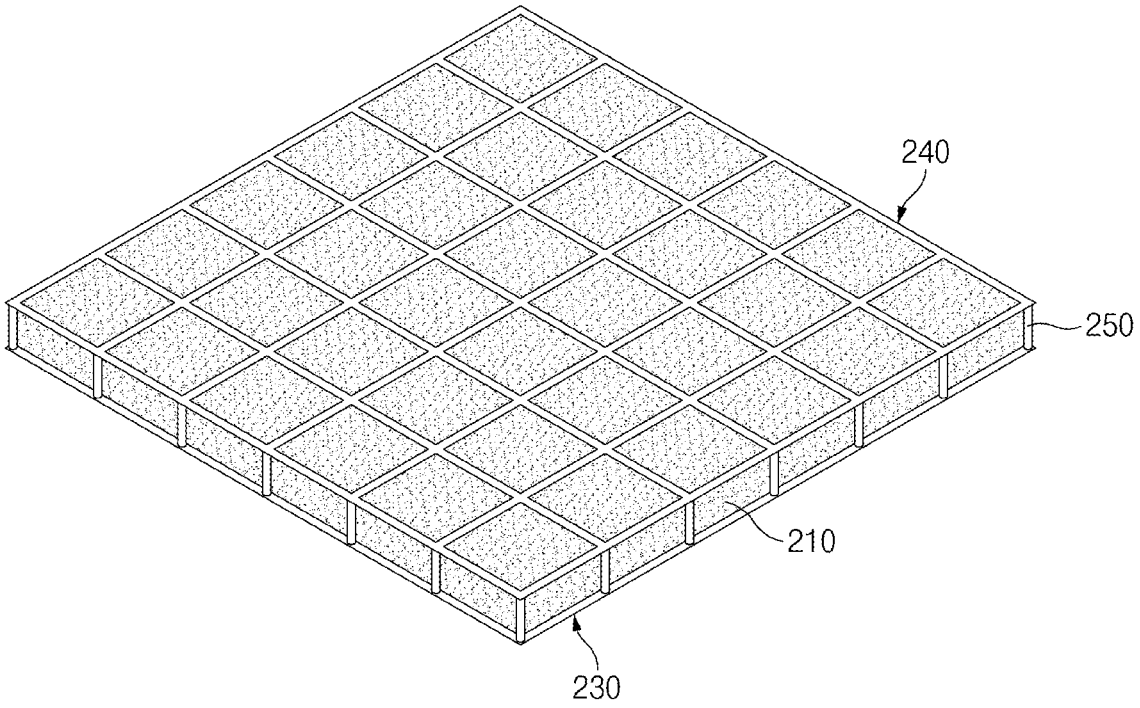
FIG. 3 and FIG. 4 are views for explaining a porous base layer of the electrochemical device according to the exemplary embodiment of the present disclosure.
Figure 4:
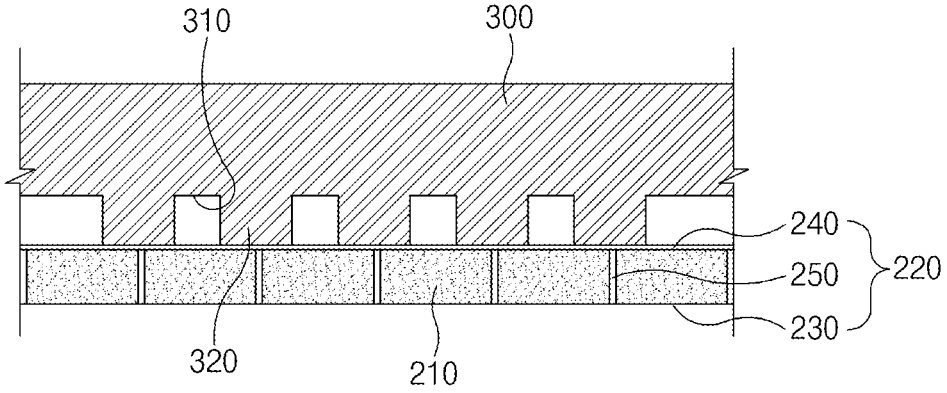

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to a same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

Hereinafter, various exemplary embodiments of the present disclosure will be described in detail with reference to the accompanying drawings.

However, the technical spirit of the present disclosure is not limited to various exemplary embodiments described herein but may be implemented in various different forms. At least one of the constituent elements in the exemplary embodiments of the present disclosure may be selectively combined and substituted for use within the scope of the technical spirit of the present disclosure.

Furthermore, unless otherwise specifically and explicitly defined and stated, the terms (including technical and scientific terms) used in the exemplary embodiments of the present disclosure may be construed as the meaning which may be commonly understood by the person with ordinary skill in the art to which the present disclosure pertains. The meanings of the commonly used terms such as the terms defined in dictionaries may be interpreted in consideration of the contextual meanings of the related technology.

Furthermore, the terms used in the exemplary embodiments of the present disclosure are for explaining the embodiments, not for limiting the present disclosure.

In the present specification, unless particularly stated otherwise, a singular form may also include a plural form. The expression "at least one (or one or more) of A, B, and C" may include one or more of all combinations that may be made by combining A, B, and C.

Furthermore, the terms such as first, second, A, B, (a), and (b) may be used to describe constituent elements of the exemplary embodiments of the present disclosure.

These terms are used only for discriminating one constituent element from another constituent element, and the nature, the sequences, or the orders of the constituent elements are not limited by the terms.

Furthermore, when one constituent element is described as being 'connected', 'coupled', or 'attached' to another constituent element, one constituent element may be connected, coupled, or attached directly to another constituent element or connected, coupled, or attached to another constituent element through yet another constituent element interposed therebetween.

Furthermore, the expression "one constituent element is provided or disposed above (on) or below (under) another constituent element" includes not only a case in which the two constituent elements are in direct contact with each other, but also a case in which one or more other constituent elements are provided or disposed between the two constituent elements. The expression "above (on) or below (under)" may mean a downward direction as well as an upward direction based on one constituent element.

With reference to FIGS. 1 to 7, a porous base layer 200 according to an exemplary embodiment of the present disclosure includes a porous base portion 210 provided between a separator 300 and a membrane electrode assembly (MEA) 100, and a porous reinforcement member 220 provided between the separator 300 and the membrane electrode assembly 100 and configured to suppress separation and deformation of the porous base portion 210.

For reference, the porous base layer 200 according to the exemplary embodiment of the present disclosure, together with the membrane electrode assembly (MEA) 100, may form an electrochemical device 10.

In the instant case, the electrochemical device 10 is defined as including both a water electrolysis stack configured to produce hydrogen and oxygen by electrochemically decomposing water and a fuel cell stack configured to generate electrical energy through a chemical reaction of fuel (e.g., hydrogen).

Hereinafter, an example will be described in which the electrochemical device 10 according to the exemplary embodiment of the present disclosure is used as the water electrolysis stack that produces hydrogen and oxygen by decomposing water through an electrochemical reaction.

This is to ensure performance and operational efficiency of the electrochemical device 10 and improve stability and reliability of the electrochemical device 10.

That is, surface pressure of the membrane electrode assembly 100 needs to be equally dispersed to ensure the stable performance, operational efficiency, and durability of the electrochemical device.

However, generally, because of structural characteristics of a separator including concave channels, through which reactant gases move, and convex lands being in contact with a porous base layer, pressure, which is applied to the inside of cells during a process of fastening a stack, is concentrated on a particular site of the separator (the land of the separator which is in contact with the porous base layer), which causes a problem of separation of a partial site (a site to which no pressure is applied) of the porous base layer corresponding to the channel of the separator (a situation in which a partial site of the porous base layer is spaced from and lifted off the membrane electrode assembly). For the present reason, it is difficult to generate uniform surface pressure between the membrane electrode assembly and the porous base layer, which degrades performance and operational efficiency of the electrochemical device. The surface pressure of the membrane electrode assembly is closely related to flows of electric charges. Contact resistance between the membrane electrode assembly and the porous base layer or between the porous base layer and the separator inevitably increases on a site where the surface pressure is locally low, which causes a problem of deterioration in performance.

Moreover, generally, when the porous base layer located between the separator and the membrane electrode assembly is excessively compressed and thus deformed or damaged by the stress locally concentrated on the particular site (land) of the separator, there is a problem in that not only a route, through which electrons produced by an electrochemical reaction are transferred, is disconnected, but also a passageway, through which produced hydrogen and water move, is disconnected. For the present reason, there is a problem in that performance and durability deteriorate.

In contrast, according to the exemplary embodiment of the present disclosure, the reinforcement member for supporting the porous base portion 210 may be provided between the separator 300 and the membrane electrode assembly 100. Therefore, it is possible to obtain an advantageous effect of minimizing the deformation of and damage to the porous base layer 200 and stably maintaining a state in which the porous base layer 200 is in contact with the membrane electrode assembly 100.

Among other things, according to the exemplary embodiment of the present disclosure, the pressure applied from the separator 300 may be dispersed by the porous reinforcement member 220 without being concentrated on the particular site of the porous base portion 210. Therefore, it is possible to obtain an advantageous effect of minimizing the separation of the porous base layer 200 and uniformity improving the surface pressure between the membrane electrode assembly 100 and the porous base layer 200.

Furthermore, according to the exemplary embodiment of the present disclosure, the structural rigidity of the porous base layer 200 may be ensured by the porous reinforcement member 220. Therefore, it is possible to generate uniform surface pressure without damaging (or breaking) the membrane electrode assembly 100 and the porous base layer 200 even in a situation in which a high fastening force and high working pressure are applied. Therefore, it is possible to obtain an advantageous effect of ensuring the performance and operational efficiency of the electrochemical device and improving the durability of the membrane electrode assembly 100 and the porous base layer 200.

The water electrolysis stack (electrochemical device) may be provided by stacking a plurality of unit cells in a reference stacking direction.

The unit cell may include a reaction layer and the separators 300 respectively stacked on one surface and the other surface of the reaction layer. The water electrolysis stack may be configured by stacking the plurality of unit cells in the reference stacking direction and then assembling endplates to the two opposite end portions of the plurality of unit cells.

The reaction layer may have various structures configured for generating the electrochemical reaction of a target fluid (e.g., water). The present disclosure is not restricted or limited by the type and structure of the reaction layer.

For example, the reaction layer may include the membrane electrode assembly (MEA) 100, and the porous base layers 200 provided to be in close contact with two opposite surfaces of the membrane electrode assembly 100.

The membrane electrode assembly 100 may be variously changed in structure and material in accordance with required conditions and design specifications, and the present disclosure is not limited or restricted by the structure and material of the membrane electrode assembly 100.

For example, the membrane electrode assembly 100 may be configured by attaching catalyst electrode layers (e.g., an anode layer and a cathode layer), in which electrochemical reactions are generated, to two opposite surfaces of an electrolyte membrane (e.g., a perfluorinated sulfonic acid ionomer-based electrolyte membrane).

For reference, water supplied to the anode layer, which is an oxidation electrode for the water electrolysis, is separated into hydrogen ions (protons), electrons, and oxygen. Accordingly, the hydrogen ions move to the cathode layer, which is a reduction electrode, through the electrolyte membrane, and the electrons move to a cathode through an external circuit. Furthermore, oxygen gas may be discharged to an anode outlet, and hydrogen ions and electrons may be converted into hydrogen gas at a cathode and then discharged to a cathode outlet.

The separators 300, together with the reaction layer (membrane electrode assembly), may form a single unit cell (water electrolysis cell). The separators 300 is configured to separate and block water (or water and oxygen) at the anode side and hydrogen produced at the cathode side by the reaction layer. The separators 300 may also be configured to ensure a flow path (flow field) of the fluid.

Furthermore, the separators 300 may also be configured to distribute heat, which is generated from the unit cell, to the entire unit cell, and the excessively generated heat may be discharged to the outside by water flowing along the separators 300.

For reference, in the exemplary embodiment of the present disclosure, the separators 300 are defined as including both an anode separator 300 and a cathode separator 300 that independently define the flow paths (channels) for water (or water and oxygen) and the flow paths (channels) for hydrogen in the water electrolysis stack.

For example, the separator 300 (anode separator), which faces one surface of the membrane electrode assembly 100, may define a flow path (channel) for water (or water and oxygen). The separator 300 (cathode separator), which faces the other surface of the membrane electrode assembly 100, may define a flow path (channel) for hydrogen.

The separator 300 may be stacked on the membrane electrode assembly 100. Channels 310, through which the target fluid (hydrogen or water) flows, may be formed in one surface of the separator 300 that faces the membrane electrode assembly 100. Lands 320, which are in contact with the porous base layer 200, may be formed on one surface of the separator 300 that faces the membrane electrode assembly 100. Cooling channels, through which a coolant flows, may be formed in the other surface of the separator 300.

The separator 300 may have various structures and be made of various materials in accordance with required conditions and design specifications. The present disclosure is not restricted or limited by the structure and material of the separator 300.

For example, the separator 300 may have an approximately quadrangular plate shape and made of metal (e.g., titanium, stainless steel, Inconel, or aluminum).

According to another exemplary embodiment of the present disclosure, the separator may be formed in a shape of a circle or other shapes. The separator may be made of other materials such as graphite or a carbon composite.

With reference to FIG. 1, FIG. 2, FIG. 3, FIG. 4, and FIG. 5, the porous base layer 200 is provided between the membrane electrode assembly 100 and the separator 300 and is configured to uniformly distribute (move or discharge) the target fluid (e.g., water or hydrogen) while provided as a movement passage for electrons. The porous base layer 200 includes the porous base portion 210 provided between the separator 300 and the membrane electrode assembly 100, and the porous reinforcement member 220 provided between the separator 300 and the membrane electrode assembly 100 and configured to suppress the separation and deformation of the porous base portion 210.

The porous base portion 210 may be configured as a typical porous structure including pores. The present disclosure is not restricted or limited by the structure of the porous base portion 210 and the method of manufacturing the porous base portion 210.

For example, the porous base portion 210 may be provided to be similar in characteristics to a typical anode porous transport layer (PTL).

According to the exemplary embodiment of the present disclosure, the porous base portion 210 may be manufactured by forming base layer slurry SL containing metal elements into an approximately plate shape (e.g., by a powder metallurgy process, a tape casting process, a web process, or an injection molding process) and then performing a heat treatment process (a degreasing process and a sintering process).

The base layer slurry SL may be provided by mixing various materials in accordance with required conditions and design specifications. The present disclosure is not restricted or limited by the types of materials, which form the base layer slurry SL, and the composition ratios of the materials.

For example, the base layer slurry SL may be provided by mixing a metal element, a solvent, a dispersant, and a coupling agent.

At least any one of a wire type metal element, a powder type metal element, and a mesh type metal element may be used as the metal element included in the base layer slurry SL.

For example, the metal element may include a titanium family element. More particularly, titanium family elements may include at least any one of titanium, zirconium, and hafnium.

According to another exemplary embodiment of the present disclosure, other metal elements such as nickel or stainless steel may be used, instead of the titanium family element, as the metal element.

The porous reinforcement member 220 may be provided between the separator 300 and the membrane electrode assembly 100 and support the porous base portion 210, suppressing the separation and deformation of the porous base portion 210.

In the instant case, the separation and deformation of the porous base portion 210 may be understood as a situation in which a portion of the porous base portion 210 is approximately convexly deformed and separated from the membrane electrode assembly 100.

The porous reinforcement member 220 may have various structures configured for suppressing the separation and deformation of the porous base portion. The present disclosure is not restricted or limited by the structure of the porous reinforcement member 220.

According to the exemplary embodiment of the present disclosure, the porous reinforcement member 220 may have accommodation spaces 222 (open-type accommodation space) that communicate with the outside thereof. The porous base portion 210 may be accommodated in the accommodation spaces 222 to be exposed to (in contact with) the separator 300 and the membrane electrode assembly 100.

Hereinafter, an example will be described in which the porous reinforcement member 220 has a thickness and size (area) corresponding to those of the porous base portion 210. According to another exemplary embodiment of the present disclosure, the porous reinforcement member 220 may be configured to have a thickness different from a thickness of the porous base portion 210 (e.g., include a smaller thickness than the porous base portion 210).

For example, the porous reinforcement member 220 may have an open-type quadrangular casing structure open in all directions.

According to the exemplary embodiment of the present disclosure, the porous reinforcement member 220 may include a first frame portion 230 provided on one surface of the porous base portion 210, a second frame portion 240 provided on the other surface of the porous base portion 210, and support frame portions 250 each including one end portion connected to the first frame portion 230, and the other end portion connected to the second frame portion 240, the support frame portions 250 being configured to support the second frame portion 240 on the first frame portion 230. The first frame portion 230, the second frame portion 240, and the support frame portions 250 may collectively define the accommodation spaces 222.

Hereinafter, an example will be described in which the first frame portion 230, the second frame portion 240, and the support frame portions 250 define the plurality of accommodation spaces 222 each including an approximately quadrangular box shape.

The first frame portion 230 may have various structures in accordance with required conditions and design specifications. The present disclosure is not restricted or limited by the structure and shape of the first frame portion 230.

For example, the first frame portion 230 may include first-first frames 232 provided in a first direction (e.g., an X-axis direction), first-second frames 234 connected to the first-first frames 232 in a second direction (e.g., a Y-axis direction) intersecting the first direction, and a first edge frame 236 connected to the first-first frame 232 and the first-second frame 234 and provided along an edge portion of the porous base portion 210. The first-first frames 232, the first-second frames 234, and the first edge frame 236 may be configured to collectively define an approximately quadrangular mesh structure.

According to the exemplary embodiment of the present disclosure, all the first-first frame 232, the first-second frame 234, and the first edge frame 236 may be formed in straight shapes. According to another exemplary embodiment of the present disclosure, the first-first frame, the first-second frame, and the first edge frame may be formed in curved shapes or other shapes.

The second frame portion 240 may have various structures in accordance with required conditions and design specifications. The present disclosure is not restricted or limited by the structure and shape of the second frame portion 240.

For example, the second frame portion 240 may include second-first frames 242 provided in the first direction (e.g., the X-axis direction), second-second frames 244 connected to the second-first frames 242 in the second direction (e.g., the Y-axis direction) intersecting the first direction, and a second edge frame 246 connected to the second-first frames 242 and the second-second frames 244 and provided along the edge portion of the porous base portion 210. The second-first frames 242, the second-second frames 244, and the second edge frame 246 may be configured to collectively define an approximately quadrangular mesh structure.

According to the exemplary embodiment of the present disclosure, all the second-first frame 242, the second-second frame 244, and the second edge frame 246 may be formed in straight shapes. According to another exemplary embodiment of the present disclosure, the second-first frame, the second-second frame, and the second edge frame may be formed in curved shapes or other shapes.

The support frame portion 250 may have various structures configured for supporting the second frame portion 240 on the first frame portion 230. The present disclosure is not restricted or limited by the structure and shape of the support frame portion 250.

For example, the support frame portion 250 may have an approximately straight column shape. The support frame portions 250 may be respectively provided at intersection points between the first-first frames 232 and the first-second frames 234 (or intersection points between the second-first frames and the second-second frames), end portions of the first-first frames 232 and the first-second frames 234 (or end portions of the second-first frames and the second-second frames), and corners of the first edge frame 236 (or corners of the second edge frame).

According to another exemplary embodiment of the present disclosure, the support frame portion may be formed in a curved shape or other shapes. Alternatively, the support frame portions may be provided at only some of the intersection points between the first-first frames and the first-second frames (or the intersection points between the second-first frames and the second-second frames), the end portions of the first-first frames and the first-second frames (or the end portions of the second-first frames and the second-second frames), and the corners of the first edge frame (or the corners of the second edge frame).

Because the porous reinforcement member 220 includes the thickness and size (area) corresponding to those of the porous base portion 210, the first edge frame 236, the second edge frame 246, and the support frame portions 250 may be disposed to define the respective corners of the porous base portion 210.

A size of the accommodation space 222 of the porous reinforcement member 220 (e.g., an interval between the adjacent first-first frames 232 or an interval between the adjacent first-second frames 234) may be defined to be sufficiently greater than a size of the metal element (e.g., the titanium element) included in the base layer slurry SL.

For example, the interval between the adjacent first-first frames 232 (or the interval between the adjacent first-second frames) may be defined as 1 to 3 mm, and the porous base portion 210 may have a porosity of 60 to 80%.

According to the exemplary embodiment of the present disclosure, the porous reinforcement member 220 may be configured to support the land 320 of the separator 300 on the membrane electrode assembly 100.

For example, the first-first frame 232 and the first-second frame 234 of the first frame portion 230, which face the land 320 of the separator 300, may be disposed to overlap the land 320 of the separator 300. The pressure applied through the land 320 of the separator 300 may be dispersed along the first-first frame 232 and the first-second frame 234.

As described above, according to the exemplary embodiment of the present disclosure, the reinforcement member for supporting the porous base portion 210 may be provided between the separator 300 and the membrane electrode assembly 100. Therefore, it is possible to obtain an advantageous effect of minimizing the deformation of and damage to the porous base layer 200 and stably maintaining a state in which the porous base layer 200 is in contact with the membrane electrode assembly 100.

Among other things, according to the exemplary embodiment of the present disclosure, the pressure applied from the separator 300 may be dispersed by the porous reinforcement member 220 without being concentrated on the particular site (the site of the separator 300 with which the land 320 is in contact) of the porous base portion 210. Therefore, it is possible to obtain an advantageous effect of minimizing the separation of the porous base layer 200 and uniformity improving the surface pressure between the membrane electrode assembly 100 and the porous base layer 200.

Furthermore, according to the exemplary embodiment of the present disclosure, the structural rigidity of the porous base layer 200 may be ensured by the porous reinforcement member 220. Therefore, it is possible to generate uniform surface pressure without damaging (or breaking) the membrane electrode assembly 100 and the porous base layer 200 even in a situation in which a high fastening force and high working pressure are applied. Therefore, it is possible to obtain an advantageous effect of ensuring the performance and operational efficiency of the electrochemical device and improving the durability of the membrane electrode assembly 100 and the porous base layer 200.

The porous reinforcement member 220 may be made of various materials in accordance with required conditions and design specifications. The present disclosure is not restricted or limited by the material and properties of the porous reinforcement member 220.

According to the exemplary embodiment of the present disclosure, the porous reinforcement member 220 may be made of the same material as the porous base portion 210. Hereinafter, an example will be described in which the porous reinforcement member 220 is made of titanium. Alternatively, the porous reinforcement member 220 may be made of a material different from a material of the porous base portion 210.

The porous reinforcement member 220 may be manufactured in various ways in accordance with required conditions and design specifications.

For example, the porous reinforcement member 220 may be manufactured by 3D printing. According to another exemplary embodiment of the present disclosure, the porous reinforcement member 220 may be manufactured by punching a base material (base metal) including an approximately flat plate shape by use of a laser or machining. Alternatively, the porous reinforcement member may be configured by assembling or connecting a plurality of members (e.g., the first frame portion, the second frame portion, and the support frame part) independently manufactured.

According to the exemplary embodiment of the present disclosure, the porous reinforcement member 220 may be provided as a unitary one-piece structure integrated with the porous base portion 210.

In the instant case, the configuration in which the porous reinforcement member 220 and the porous base portion 210 are provided as a unitary one-piece structure is defined as a configuration in which the porous reinforcement member 220 is integrally connected to (formed with) the porous base portion 210.

For example, the porous reinforcement member 220 and the porous base portion 210 may be integrated by thermal compression.

Figure 5:
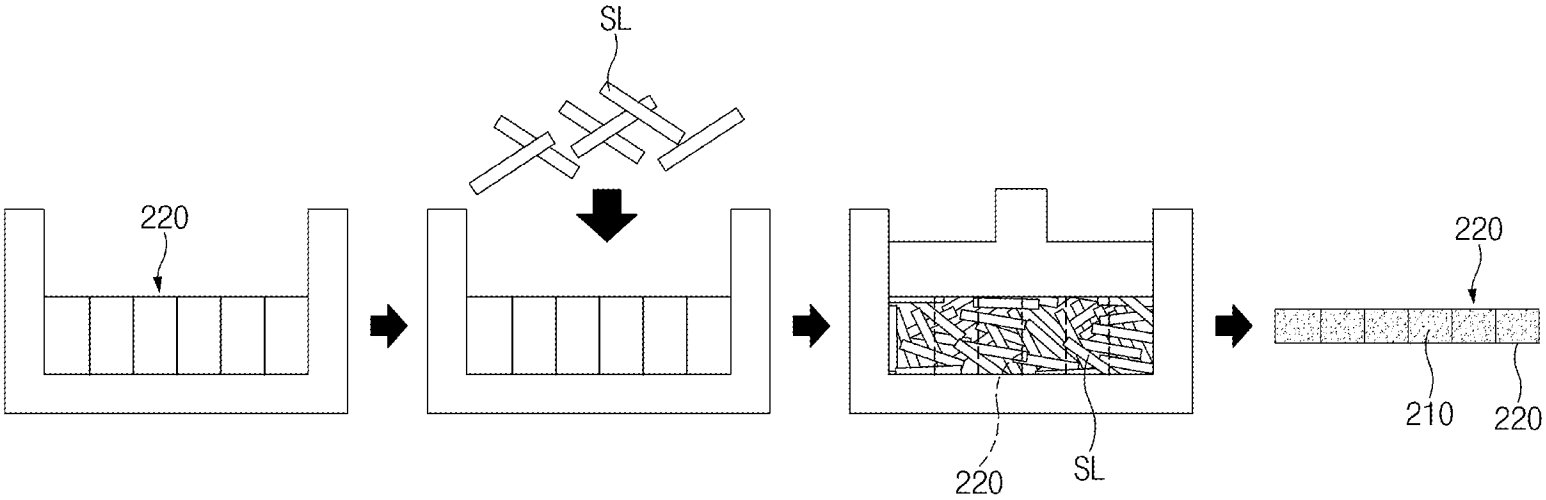
FIG. 5 is a view for explaining a process of manufacturing the porous base layer of the electrochemical device according to the exemplary embodiment of the present disclosure.

With reference to FIG. 5, when the base layer slurry SL is inputted into a mold in a state in which the porous reinforcement member 220 is disposed in the mold, the accommodation spaces 222 of the porous reinforcement member 220 may be filled with (accommodate) the base layer slurry SL. The base layer slurry SL accommodated in the accommodation spaces 222 is thermally compressed by a compression portion so that the porous reinforcement member 220 and the porous base portion 210 may be connected as a unitary one-piece structure.

Meanwhile, in the exemplary embodiment of the present disclosure illustrated and described above, the example has been described in which the porous reinforcement member 220 has the thickness (height) corresponding to that of the porous base portion 210. However, according to another exemplary embodiment of the present disclosure, the porous reinforcement member may have a smaller thickness than the porous base portion.

Figure 6:
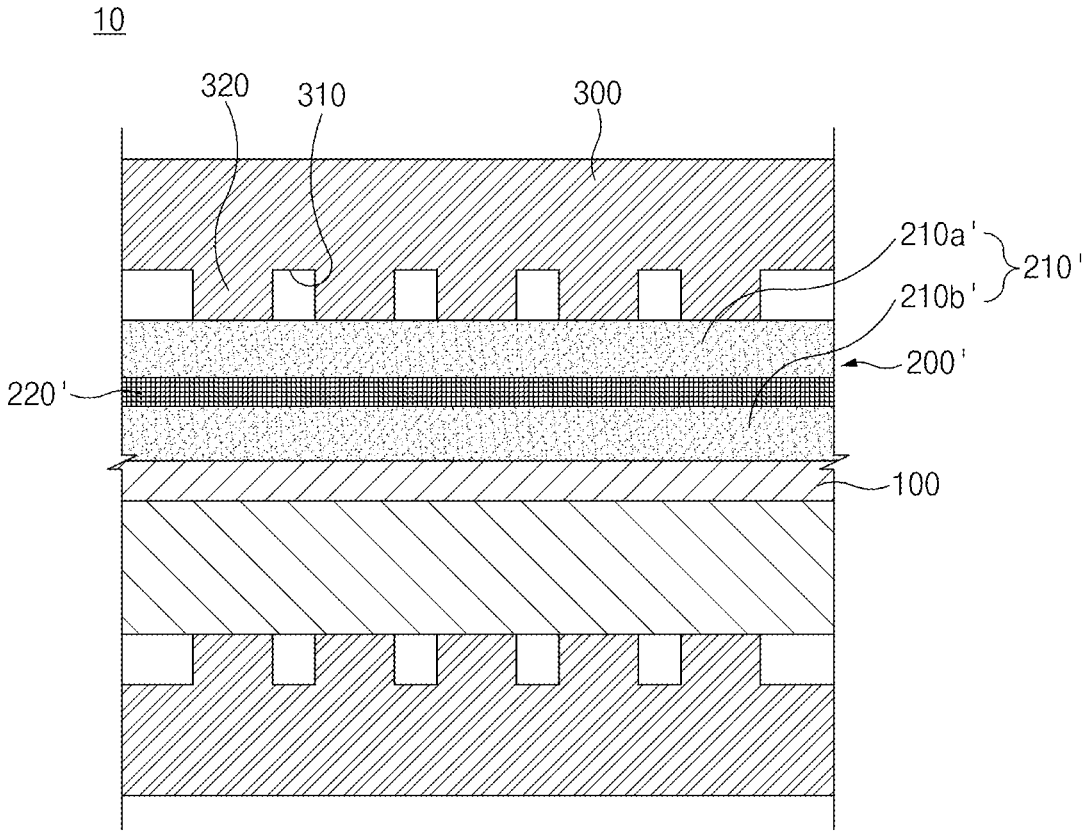
FIG. 6 is a view for explaining an electrochemical device according to another exemplary embodiment of the present disclosure.

For example, with reference to FIG. 6, the electrochemical device 10 according to another exemplary embodiment of the present disclosure includes the membrane electrode assembly 100, the separator 300, and a porous base layer 200'. The porous base layer 200' includes a porous base portion 210' provided between the separator 300 and the membrane electrode assembly 100, and a porous reinforcement member 220' including a smaller thickness than the porous base portion 210' and configured to suppress the separation and deformation of the porous base portion 210'.

Hereinafter, an example will be described in which the porous reinforcement member 220' is provided at an approximately center portion of the porous base portion 210' (a center portion of the porous base portion 210' based on a thickness direction).

According to the exemplary embodiment of the present disclosure, the porous base portion 210' may include a first porous base portion 210*a*' provided on one surface (upper surface based on FIG. 6) of the porous reinforcement member 220' that faces the separator 300, and a second porous base portion 210*b*' provided on the other surface (a bottom surface based on FIG. 6) of the porous reinforcement member 220' that faces the membrane electrode assembly 100. The first porous base portion 210*a*' and the second porous base portion 210*b*' may be integrally connected through the accommodation spaces (see 222 in FIG. 2) of the porous reinforcement member 220'.

Figure 7:
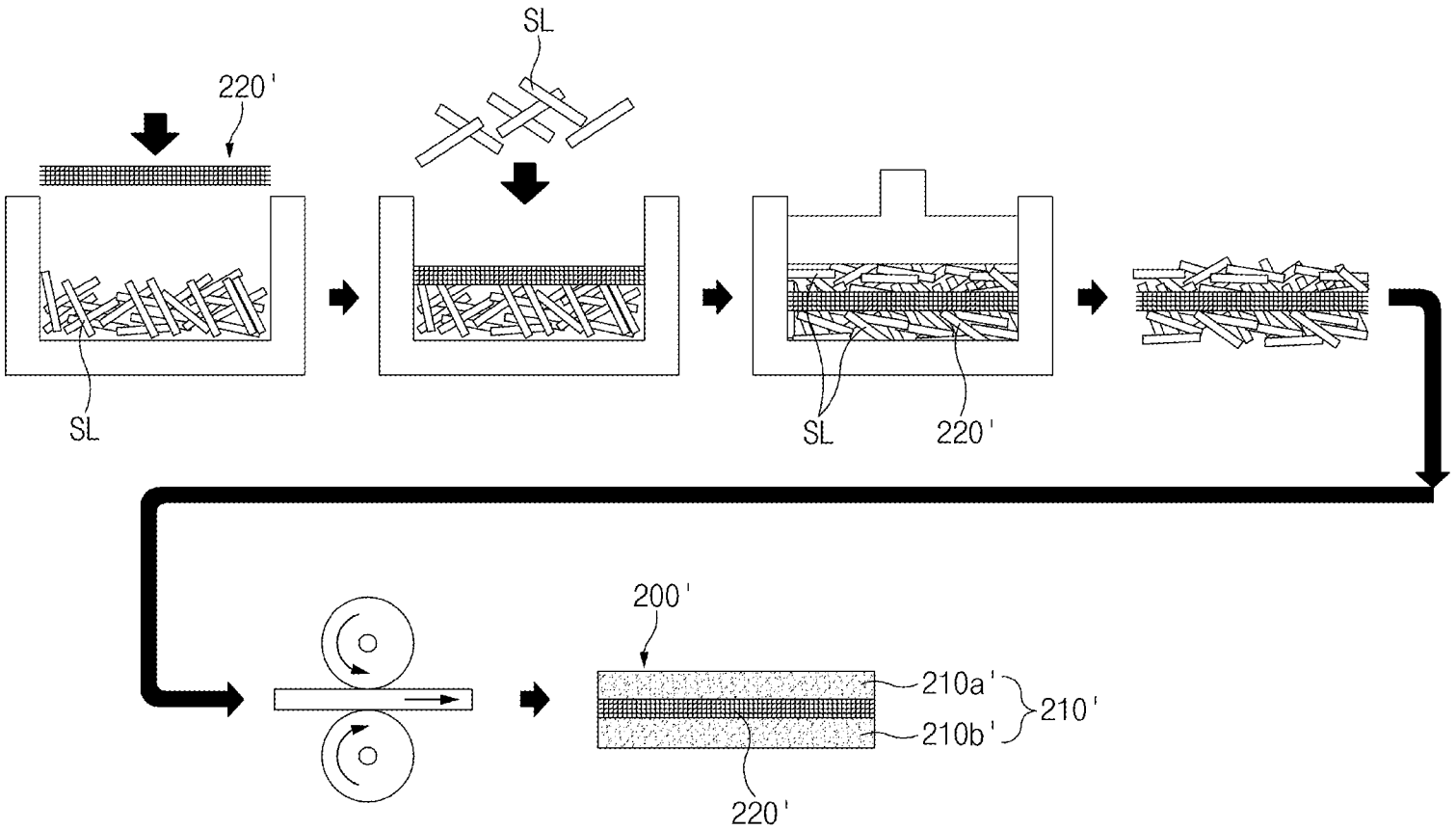
FIG. 7 is a view for explaining a process of manufacturing a porous base layer of the electrochemical device according to another exemplary embodiment of the present disclosure.

For example, with reference to FIG. 7, the base layer slurry SL (first base layer slurry) may be inputted into a mold first, the porous reinforcement member 220' may be disposed on the base layer slurry SL, and then the base layer slurry SL (second base layer slurry) may be additionally inputted into the mold. Therefore, the porous reinforcement member 220' may be disposed at an approximately center portion of the base layer slurry SL, and the accommodation spaces 222 of the porous reinforcement member 220' may be filled with (accommodate) a portion of the base layer slurry SL. Thereafter, the porous reinforcement member 220' may be integrally connected to the first porous base portion 210*a*' and the second porous base portion 210*b*' by thermally compressing the base layer slurry SL by use of the thermal compression portion. Thereafter, the porous base layer 200' including the porous base portion 210' and the porous reinforcement member 220' may be subjected to calendar processing and rolled into a preset thickness.

For reference, thicknesses of the first and second porous base portions 210*a*' and 210*b*' may be changed by adjusting the input amount of the first base layer slurry and the input amount of the second base layer slurry. The present disclosure is not restricted or limited by the thicknesses of the first and second porous base portions 210*a*' and 210*b'*.

Meanwhile, in the exemplary embodiment of the present disclosure illustrated and described above, the example has been described in which a size of the accommodation space 222 of the porous reinforcement member 220' is defined (the size of the accommodation space 222 is defined to be greater than the size of the metal element) so that the metal element included in the base layer slurry may pass through the accommodation space 222. However, according to another exemplary embodiment of the present disclosure, the size of the accommodation space 222 of the porous reinforcement member 220' may be smaller than the size of the metal element.

That is, according to another exemplary embodiment of the present disclosure, the first porous base portion 210*a*' and the second porous base portion 210*b*' may be provided by thermally compressing the base layer slurry SL including the metal element, and the porous reinforcement member 220' may be defined to have pores each including a smaller size than the metal element.

For example, the interval between the adjacent first-first frames (see 232 in FIG. 2) (or the interval between the adjacent first-second frames) may be defined to be smaller than the size of the metal element (e.g., the titanium element) included in the base layer slurry SL.

In the instant case, the first porous base portion 210*a*' and the second porous base portion 210*b*' may have different porosities.

That is, according to another exemplary embodiment of the present disclosure, the first porous base portion 210*a*' may have a first porosity, and the second porous base portion 210*b*' may have a second porosity different from the first porosity (e.g., the second porosity greater than the first porosity).

For reference, the first porosity of the first porous base portion 210*a*' may be determined depending on a particle size (e.g., an average particle size) of the metal element included in the first base layer slurry, and the second porosity of the second porous base portion 210*b*' may be determined in accordance with a particle size of the metal element included in the second base layer slurry. The present disclosure is not restricted or limited by the difference in porosities between the first porous base portion 210*a*' and the second porous base portion 210*b'*.

Meanwhile, in the exemplary embodiment of the present disclosure illustrated and described above, the example has been described in which the porous reinforcement member 220 is provided at the approximately center portion of the porous base portion 210. However, according to another exemplary embodiment of the present disclosure, the porous reinforcement member may be provided at an uppermost or lowermost end portion of the porous base portion.

Furthermore, in the exemplary embodiment of the present disclosure illustrated and described above, the example has been described in which the porous reinforcement member 220 and the porous base portion 210 are formed as a unitary one-piece structure. However, according to another exemplary embodiment of the present disclosure, the porous reinforcement member and the porous base portion may be separately manufactured, and then the porous reinforcement member and the porous base portion may be stacked on each other to form the porous base layer.

According to the exemplary embodiment of the present disclosure described above, it is possible to obtain an advantageous effect of ensuring the performance and operational efficiency and improving the durability and reliability.

According to the exemplary embodiment of the present disclosure, it is possible to obtain an advantageous effect of minimizing the deformation of and damage to the porous base layer and stably maintaining the state in which the porous base layer is in contact with the membrane electrode assembly.

Among other things, according to the exemplary embodiment of the present disclosure, it is possible to obtain an advantageous effect of minimizing a degree to which stress is concentrated on a particular site of the porous base layer with which the land of the separator is in contact and minimizing the separation of the porous base layer.

Furthermore, according to the exemplary embodiment of the present disclosure, it is possible to obtain an advantageous effect of generating entirely uniform fastening pressure (pressing force) to be applied to the porous base layer.

Furthermore, according to the exemplary embodiment of the present disclosure, it is possible to ensure the rigidity of the porous base layer and manufacture the porous base layer with a small thickness to minimize mass transport overpotential of the porous base layer.

Furthermore, according to the exemplary embodiment of the present disclosure, it is possible to obtain an advantageous effect of improving the durability, stability, and reliability.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The term "and/or" may include a combination of a plurality of related listed items or any of a plurality of related listed items. For example, "A and/or B" includes all three cases such as "A", "B", and "A and B".

In the present specification, unless particularly stated otherwise, a singular expression includes a plural expression unless the context clearly indicates otherwise.

In exemplary embodiments of the present disclosure, "at least one of A and B" may refer to "at least one of A or B" or "at least one of combinations of one or more of A and B". In addition, "one or more of A and B" may refer to "one or more of A or B" or "one or more of combinations of one or more of A and B".

In the exemplary embodiment of the present disclosure, it should be understood that a term such as "include" or "have" is directed to designate that the features, numbers, steps, operations, elements, parts, or combinations thereof described in the specification are present, and does not preclude the possibility of addition or presence of one or more other features, numbers, steps, operations, elements, parts, or combinations thereof.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described in order to explain certain principles of the invention and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. A porous base layer comprising:

a porous base portion provided between a separator and a membrane electrode assembly (MEA); and a porous reinforcement member provided between the separator and the membrane electrode assembly and configured to suppress separation and deformation of the porous base portion, wherein the porous reinforcement member includes:

a first frame portion provided on a first surface of the porous base portion;

a second frame portion provided on a second surface of the porous base portion; and a support frame portion configured to support the second frame portion on the first frame portion and including a first end portion connected to the first frame portion, and a second end portion connected to the second frame portion, and wherein the first frame portion, the second frame portion, and the support frame portion collectively define an accommodation space.

2. The porous base layer of claim 1, wherein the accommodation space is configured to communicate with the outside thereof, and wherein the porous base portion is accommodated in the accommodation space to be exposed to the separator and the membrane electrode assembly.

3. The porous base layer of claim 2, wherein the porous reinforcement member includes a thickness corresponding to a thickness of the porous base portion.

4. The porous base layer of claim 1, wherein the first frame portion includes:

a first-first frame provided in a first direction;

a first-second frame connected to the first-first frame in a second direction intersecting the first direction; and a first edge frame connected to the first-first frame and the first-second frame and provided along an edge portion of the porous base portion.

5. The porous base layer of claim 1, wherein the second frame portion includes:

a second-first frame provided in a first direction;

a second-second frame connected to the second-first frame in a second direction intersecting the first direction; and a second edge frame connected to the second-first frame and the second-second frame and provided along an edge portion of the porous base portion.

6. The porous base layer of claim 1, wherein the porous reinforcement member and the porous base portion are provided as a unitary one-piece structure.

7. The porous base layer of claim 1, wherein the porous reinforcement member is made of a same material as the porous base portion.

8. The porous base layer of claim 1, wherein a channel, through which a target fluid flows, is defined in one surface of the separator that faces the membrane electrode assembly, wherein a land, with which the porous base portion is in contact, is defined on one surface of the separator that faces the membrane electrode assembly, and wherein the porous reinforcement member supports the land on the membrane electrode assembly.

9. A porous base layer comprising:

a porous base portion provided between a separator and a membrane electrode assembly (MEA); and a porous reinforcement member provided between the separator and the membrane electrode assembly and configured to suppress separation and deformation of the porous base portion, wherein the porous base portion includes:

a first porous base portion provided on a first surface of the porous reinforcement member that faces the separator; and a second porous base portion provided on a second surface of the porous reinforcement member, and wherein the first porous base portion and the second porous base portion are integrally connected through an accommodation space of the porous reinforcement member, wherein the first porous base portion and the second porous base portion are provided by thermally compressing base layer slurry including a metal element, and wherein the porous reinforcement member has a pore smaller in size than the metal element.

10. The porous base layer of claim 9, wherein the first porous base portion includes a first porosity, and the second porous base portion has a second porosity different from the first porosity.

11. An electrochemical apparatus comprising:

a membrane electrode assembly (MEA);

a separator stacked on the membrane electrode assembly; and a porous base layer provided between the separator and the membrane electrode assembly, wherein the porous base layer includes:

a porous base portion provided between the separator and the membrane electrode assembly; and a porous reinforcement member provided between the separator and the membrane electrode assembly and configured to suppress separation and deformation of the porous base portion, wherein the porous reinforcement member includes:

a first frame portion provided on a first surface of the porous base portion;

a second frame portion provided on a second surface of the porous base portion; and a support frame portion configured to support the second frame portion on the first frame portion and including a first end portion connected to the first frame portion, and a second end portion connected to the second frame portion, and wherein the first frame portion, the second frame portion, and the support frame portion collectively define an accommodation space.

12. The electrochemical apparatus of claim 11, wherein the accommodation space is configured to communicate with the outside thereof, and wherein the porous base portion is accommodated in the accommodation space to be exposed to the separator and the membrane electrode assembly.

13. The electrochemical apparatus of claim 12, wherein the porous reinforcement member has a thickness corresponding to a thickness of the porous base portion.

14. The electrochemical apparatus of claim 11, wherein the first frame portion includes:

a first-first frame provided in a first direction;

a first-second frame connected to the first-first frame in a second direction intersecting the first direction; and a first edge frame connected to the first-first frame and the first-second frame and provided along an edge portion of the porous base portion.

15. The electrochemical apparatus of claim 11, wherein the second frame portion includes:

a second-first frame provided in a first direction;

a second-second frame connected to the second-first frame in a second direction intersecting the first direction; and a second edge frame connected to the second-first frame and the second-second frame and provided along an edge portion of the porous base portion.

16. The electrochemical apparatus of claim 11, wherein a channel, through which a target fluid flows, is defined in one surface of the separator that faces the membrane electrode assembly, wherein a land, with which the porous base portion is in contact, is defined on one surface of the separator that faces the membrane electrode assembly, and wherein the porous reinforcement member supports the land on the membrane electrode assembly.

17. The electrochemical apparatus of claim 11, wherein the porous base portion includes:

a first porous base portion provided on a first surface of the porous reinforcement member that faces the separator; and a second porous base portion provided on a second surface of the porous reinforcement member, and wherein the first porous base portion and the second porous base portion are integrally connected through the accommodation space of the porous reinforcement member.

* * * * *